US012607432B2

(12) United States Patent
Wilson et al.

(10) Patent No.: US 12,607,432 B2
(45) Date of Patent: Apr. 21, 2026

(54) HOLSTER FOR CONDUCTED ENERGY DEVICE WITH CONTROL ACCESS

(71) Applicants: Robert Wilson, Cincinnati, OH (US); Ryan Jones, Loveland, OH (US)

(72) Inventors: Robert Wilson, Cincinnati, OH (US); Ryan Jones, Loveland, OH (US)

( * ) Notice: Subject to any disclaimer, the term of this patent is extended or adjusted under 35 U.S.C. 154(b) by 43 days.

(21) Appl. No.: 18/657,943

(22) Filed: May 8, 2024

(65) Prior Publication Data

US 2025/0035404 A1 Jan. 30, 2025

Related U.S. Application Data

(60) Provisional application No. 63/516,087, filed on Jul. 27, 2023.

(51) Int. Cl.
*F41C 33/02* (2006.01)
*F41H 13/00* (2006.01)

(52) U.S. Cl.
CPC ..... *F41C 33/029* (2013.01); *F41H 13/0025* (2013.01)

(58) Field of Classification Search
None
See application file for complete search history.

(56) References Cited

U.S. PATENT DOCUMENTS 4,886,197 A * 12/1989 Bowles ..... F41C 33/0227 224/245
5,525,966 A * 6/1996 Parish ..... G08B 21/02 340/568.1
8,575,887 B1 * 11/2013 Pomare ..... H02J 7/0044 320/101
8,851,344 B2 10/2014 Baumann et al.
9,010,003 B2 4/2015 Brundula et al.
9,025,304 B2 5/2015 Brundula et al.
D776,424 S 1/2017 Faifer
10,458,748 B2 10/2019 Yeates
11,506,466 B2 11/2022 Smith et al.
11,561,064 B2 1/2023 Gregory et al.
11,920,902 B2 3/2024 Batchelder
2003/0042279 A1 * 3/2003 Locklear, III ..... F41C 33/0209 224/244
2006/0208025 A1 9/2006 Grundy et al.
2006/0285363 A1 * 12/2006 Chen ..... G06F 1/1601 362/634
2011/0169451 A1 * 7/2011 Stampfli ..... H04R 1/1033 224/576
2012/0223110 A1 * 9/2012 Gregory ..... F41C 33/0209 224/193

(Continued)

*Primary Examiner* — Steven M Marsh
(74) *Attorney, Agent, or Firm* — Jenei LLC

(57) ABSTRACT

The present invention discloses a holster for a conducted energy device. The holster comprises a holster body having a cavity to receive the conducted energy device. The conducted energy device comprises one or more switches to control one or more functions of the conducted energy device. The holster further comprises one or more access modules integrated at an outer surface of the holster body. The access module is configured to activate the switches while the conducted energy device is secured within the holster to control the functions including energization of the conducted energy device. The access module includes an opening to expose the switch. The opening enables a user to access the switch.

11 Claims, 10 Drawing Sheets

(56) References Cited

U.S. PATENT DOCUMENTS

| | | | | |
|---|---|---|---|---|
| 2014/0162584 | A1* | 6/2014 | Cope | F41C 33/0227<br>455/404.1 |
| 2019/0346233 | A1 | 11/2019 | Rorick et al. | |
| 2020/0217626 | A1 | 7/2020 | Haole | |
| 2023/0114957 | A1* | 4/2023 | Alrakah | A61B 5/0022<br>224/243 |
| 2024/0011734 | A1* | 1/2024 | DeRenzo | F41C 33/0236 |
| 2024/0377159 | A1* | 11/2024 | Gish | F41C 33/0209 |

* cited by examiner

HOLSTER FOR CONDUCTED ENERGY DEVICE WITH CONTROL ACCESS

CROSS-REFERENCE TO RELATED APPLICATIONS

This application is a U.S. Nonprovisional patent application, which claims the benefit of U.S. Provisional Patent Application Ser. No. 63/516,087, entitled "HOLSTER FOR ELECTRICAL ENERGY DEVICE WITH CONTROL ACCESS", filed Jul. 27, 2023, the contents of which are hereby incorporated by reference in their entirety for any purpose.

TECHNICAL FIELD

The present disclosure relates generally to a holster, and more particularly, to a holster for a conducted energy device.

BACKGROUND

Defensive electricity discharge devices or conducted energy devices (hereinafter referred as "conducted energy device" or "CED") such as TASER® brand products (Axon Enterprise, Inc., Phoenix, AZ) have been known for many years to disable or discourage an attacker.

A conducted energy device (CED) is a "less-lethal" electroshock device primarily used to incapacitate people, allowing them to be approached and handled in an unresisting manner. For the purposes of the present invention, the terms conducted energy weapons (CEW), conducted energy device (CED), projectile electric shock weapon (PEW), and electrical muscular disruption ("EMD") weapons are used interchangeable, and can be used to refer to the class of devices that includes TASERS® and stun guns, and any other device designed deploy electrodes that transmit an electrical charge or current to temporarily disable a person. Typically, a CED is a handheld device with a trigger, a safety, probes wired to a pulse generator and pulse controller, and disposable cartridges that use compress gas such as nitrogen to launch the probes. Once the safety is off and the trigger is depressed, the CED deploys two probes into a subject's body. The wires that connect the probes to the pulse generator transmit strong electrical pulses into the subject's body, thus immobilizing or incapacitating the subject by interfering with the subject's nervous system.

The conducted energy devices are generally carried in a holster to protect and hold the weapon securely in place. The holster is typically worn on a belt at the waist, on the thigh, under an arm, or around an ankle. Additionally, a holster may be used in conjunction with some tactical vests. The holster generally includes an attachment member, for example, vest, belt, strap, or harness to secure the holster to the body of a user. The holster further includes a storage area for securing the conducted energy device and a closure member to fasten the conducted energy device within the storage device. Generally, the holster and the closure member are designed to prevent unintentional dislodgement of the conducted energy device from the holster and removal of the conducted energy device from the holster without the consent of the user. However, such design limits the options available to the user to continue using the device once deployed.

Further, the existing design of closure member hinders users to unfasten quickly and efficiently. For example, in situations where the user such as a police officer needs to cuff the criminal, the officer needs to simultaneously apprehend the criminal using cuffs or bind them manually and also energize the conducted energy device to disable the criminal. To activate the energizing function of the conducted energy device, the officer needs both hands to detach the closure member, remove the conducted energy device from the holster and activate the energizing function of the conducted energy device, which makes the officer and also a person or objects need to protected by the officer left vulnerable to danger.

Hence, there is a need for a holster that allows a user to re-energize a conducted energy device's existing circuit that has effectively achieved Neuromuscular Incapacitation (NMI) instantly without removing the device from the holster or requiring the usage of both hands of the user. Further, there is a need for a holster that enables the user to control one or more functions of the conducted energy device while being secured in the holster.

SUMMARY OF THE INVENTION

The present invention discloses a holster for a conducted energy device. According to the present invention, the holster comprises a holster body. The holster body includes a cavity to receive the conducted energy device. The conducted energy device comprises one or more switches to control one or more functions of the conducted energy device. The holster further comprises one or more access modules integrated at an outer surface of the holster body. In another embodiment, the access module is provided as a separate unit from the holster. The access module is configured to activate the switches while the conducted energy device is secured within the holster to control the functions including re-energization of the conducted energy device.

In one embodiment, the access module is an opening to expose the switch. The opening enables a user to access the switch. In another embodiment, the access module comprises a cover member that extends across the opening to manage access to the opening. In one embodiment, the cover member is coupled to the holster body via a hinge. The cover member is configured to pivot about the hinge to provide access to the opening.

In yet another embodiment, the access module comprises a depressible switch configured to depress for a predefined depth, which enables the depressible switch to contact and press against the switch of the conducted energy device, and activate the functions of the conducted energy device. In yet another embodiment, the access module defines an opening configured to expose a portion of the device to directly provide access to the switches.

In yet another embodiment, the access module is a flexible portion integrally formed at the surface of the holster body. The surface of the flexible portion corresponds to a position of the switch of the conducted energy device while secured within the cavity. The flexible portion is enabled to depress for a predefined depth, thereby enabling the user to press the flexible portion against the switch of the conducted energy device to control the functions of the conducted energy device. In yet another embodiment, the access module defines a portion cutaway from the holster body configured to expose a portion of the device to directly provide access to the switches. The holster further comprises a preventor to prevent movement of an ambidextrous selector switch of the conducted energy device. The preventor is a portion extends from the holster body. The preventor is configured to lie adjacent to the selector switch of the conducted energy device while the conducted energy device is secured within the cavity.

In yet another embodiment, the access module comprises a wireless module configured to wirelessly activate the switch. In one embodiment, the control component further comprises one or more actuators. In one embodiment, the control component comprises an on actuator and an off actuator.

Other embodiments include a device comprising a control component, and a selector, where the selector is adapted to allow a user the option to re-energize a conducted energy device's existing circuit that has effectively achieved Neuromuscular Incapacitation (NMI) instantly without removing the device from the holster or requiring the usage of both hands of the user. In another embodiment, the selector allows the holster to be configured for either a left or right handed user. As readily apparent to one of skill in the art, and in accordance with various embodiments herein, the control box or control component may come in any variety of shapes and configurations and is in no way limited to only the box diagrams or explicit shapes described herein. Other embodiments include a device comprising a control component adapted to allow a user the option of actuating functions on a conducted energy device without unholstering the device. In one embodiment, the holster will have a portion or additional component that prevents the taser from powering on or off while holstered. This holster portion or additional component ensures the device is not accidentally turned on when it's not in use and will ensure it is not accidentally turned off if it is being holstered to be used according to the present invention.

The holster body may be manufactured from any firearm holster material known in the art such as, but not limited to: leather, plastic, thermoplastic acrylic-polyvinyl chloride, etc. In another embodiment, the device is made of a polymer material. In another embodiment, the device includes one or more of the following materials: polyphenylene sulfide (PPS), polyethylene terephthalate, polyetheretherketone, polybutylene terephthalate, Ertalyte TX, PEEK, Torlon, Delrin, PET, Vespel, and Duratrol. In another embodiment, the device is made from a Delrin mold. In one embodiment, the holster allows for a straight draw or return of a conducted energy device, no rotation is necessary.

Moreover, the holster disclosed herein may be used in conjunction with variety of models of conducted energy device, such as TASER®, etc. The holster may also be used in conjunction with variety of light accessories, such as laser sighting, flashlight. It is also contemplated that the holster can be used with waist strap, shoulder strap, leg strap, concealed or open carry, etc. In one embodiment, the holster disclosed herein incorporates straps, flaps, etc. that are used along with the holster. In one embodiment, the holster disclosed herein incorporate an alert system for detecting and reporting weapon draw and/or deployment in real-time.

Moreover, the holster disclosed herein may be used in conjunction with variety of models of tactical vests for which a holster device may be mounted on or incorporated in. Tactical vests, e.g., bullet-proof vests, body armor, flak jackets and other such vests (hereinafter referred to generally as "tactical vests") typically include a textile vest in or on which various loads are provided.

Other features and advantages of the invention will become apparent from the following detailed description, taken in conjunction with the accompanying drawings, which illustrate, by way of example, various embodiments of the invention.

DETAILED DESCRIPTION OF EXAMPLE EMBODIMENTS

Figure 1:
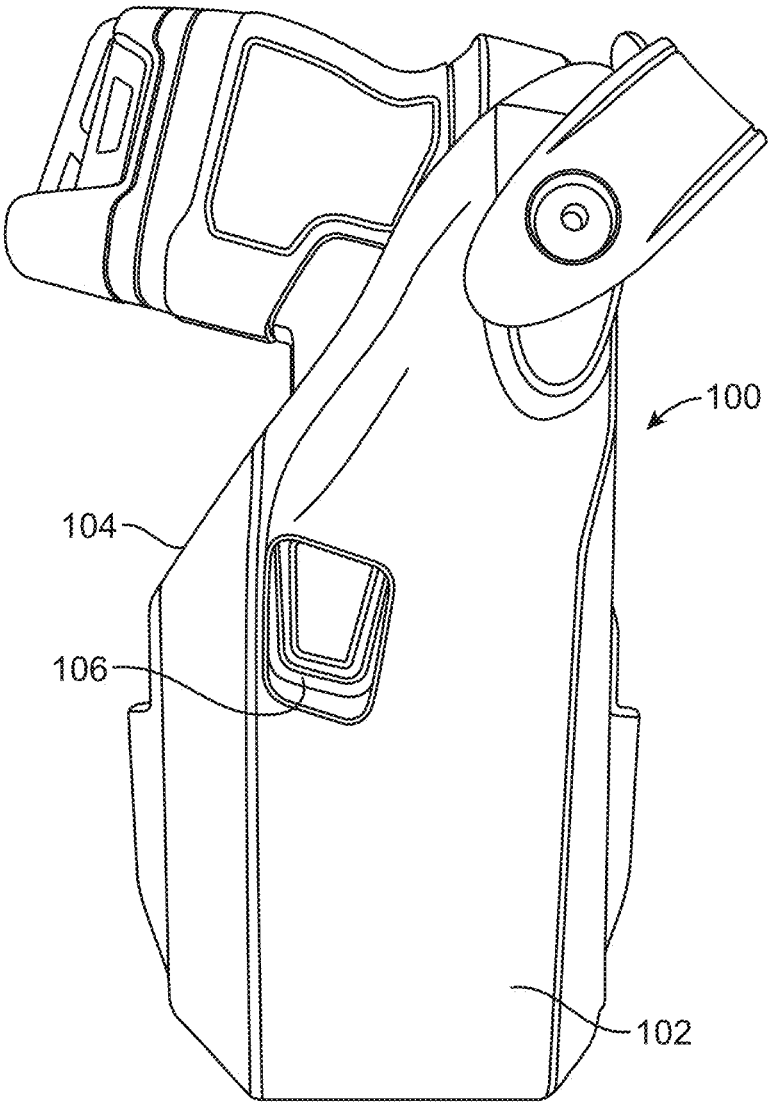
FIG. 1 exemplarily illustrates a perspective view of a holster with a conducted energy device comprising an access module configured to allow activation of one or more switches of the device while the device is within the holster, according to an embodiment of the present invention.

Example embodiments of the disclosure now will be described more fully hereinafter with reference to the accompanying drawings, in which example embodiments are shown. The concepts discussed herein may, however, be embodied in many different forms and should not be construed as limited to the example embodiments set forth herein; rather, these embodiments are provided so that this disclosure will be thorough and complete, and will fully convey the scope to those of ordinary skill in the art. Like numbers refer to like elements but not necessarily the same or identical elements throughout.

The holster apparatuses described herein may be used with various conducted energy devices (CEDs), which may be used to interfere with voluntary locomotion (e.g., walking, running, moving, etc.) of a target. For example, a conducted energy device (CED) may be used to deliver a current (e.g., stimulus signal, pulses of current, pulses of charge, etc.) through tissue of a human or animal target. Although typically referred to as a conducted energy device, as described herein a "CED" may refer to a conducted energy device, a conducted energy weapon, and/or any other similar device or apparatus configured to provide a stimulus signal through one or more deployed projectiles (e.g., electrodes).

A stimulus signal may be delivered through the target via one or more (typically at least two) wire-tethered electrodes. Delivery via wire-tethered electrodes may be referred to as a remote delivery (e.g., a remote stun). During a remote delivery, the CED may be separated from the target up to the length (e.g., 15 feet, 20 feet, 30 feet, etc.) of the wire tether. The CED launches the electrodes towards the target. As the electrodes travel toward the target, the respective wire tethers deploy behind the electrodes. The wire tether electrically couples the CED to the electrode. The electrode may electrically couple to the target thereby coupling the CED to the target. In response to the electrodes connecting with, impacting on, or being positioned proximate to the target's tissue, the current may be provided through the target via the electrodes (e.g., a circuit is formed through the first tether and the first electrode, the target's tissue, and the second electrode and the second tether). Contact of a terminal or electrode with the target's tissue establishes an electrical coupling (e.g., circuit) with the target's tissue.

A deployment of the CED may launch one or more electrodes toward a target to remotely deliver the stimulus signal through the target. In various embodiments, a CED may receive one or more cartridges (e.g., deployment units, etc.). Each cartridge may releasably electrically, electronically, and/or mechanically couple to the CED prior to and during use of the cartridge to provide a stimulus signal in the form of an electrical current at a voltage.

In various embodiments, a cartridge may include two or more electrodes that are launched at the same time. In various embodiments, a cartridge may include two or more electrodes that may be launched individually at separate times. Launching the electrodes may be referred to as deploying (e.g., firing) a cartridge. When the CED deploys the cartridges, the CED transmits electrical pulses along the wires and into the body through electrodes, which are designed to affect the sensory and motor functions of the peripheral nervous system and cause involuntary muscle contractions. After deployment (e.g., activation, firing), a cartridge may be removed from the CED and replaced with an unused, undeployed (e.g., not fired) cartridge to permit launch of additional electrodes.

Typically, the cartridges apply an initial trigger-initiated burst of conducted electrical energy for a set duration, for example 1, 3, 5, or more seconds, after which the CED will shut down after the initial trigger-initiated energy burst has been delivered. It is possible to apply additional conducted electrical energy beyond the initial deployment burst to a cartridge without deploying another cartridge. In various embodiments, the CED may be re-energized (apply an additional burst of conducted electrical energy or current) by actuating a switch that allows for re-energizing the electrodes after being deployed. In various embodiments, the CED may be re-energized for a set length of time. In various embodiments, the CED may be re-energized for the duration that the re-energizing switch is held in position. Typically, the re-energizing switch is not the same as the trigger as actuating the trigger will cause deployment of a new cartridge. Typically, the trigger of the CED is covered when holstered such that the trigger is not exposed allowing access for an accidental deployment of the device.

Referring to FIG. 1, the present invention discloses a holster 100 for a conducted energy device 114. The holster 100 is configured to enable a user to control one or more functions of the conducted energy device 114 (shown in FIG. 6 and FIG. 7) while the device 114 is secured within the holster 100. In particular, the holster 100 is configured to enable a user to re-energize the conducted energy device 114 (also referred as device 114) while the device 114 is secured within the holster 100. The control to re-energize the device 114 while the device 114 is secured within the holster 100 enables the user to deliver an additional conducted electrical energy (current) beyond the initial deployment burst from the device 114 instantaneously during immediate dangers.

Additionally, the holster 100 is configured to enable a user to re-energize the conducted energy device 114 with a firsthand while allowing the second hand to be used to restrain or otherwise take action with a person or persons. Such configuration also frees up the first hand immediately once the re-energizing control switch has been engaged for re-energization. The holster 100 comprises a holster body 102 comprising a cavity 104 to receive the conducted energy device 114 therein. The holster 100 further comprises an access module configured to activate one or more switches while the device 114 is within the holster 100 to control one or more functions of the discharge device 114.

Currently, if the barbs are deployed into a target, the wires will run from the subject to the device 114. If you holster the device 114, and you push it into the holster the wires will most likely be pinched and pulled from discharged cartridges remaining in the device 114. In one or more embodiments, the holster 100 comprises additional cavity space within cavity 104 to accept the filaments or wire tethers that connects to the electrodes. Specifically, the cavity 104 should be dimensioned to facilitate the holstering of the CED 114 while the wire tethers are still attached and to allow the wire tethers to not be pinched and pulled from the CED 114, which would break the connection of the electrical circuit. Breaking the connection will render the circuit useless and prevent any additional re-energization of that circuit.

Figure 6:
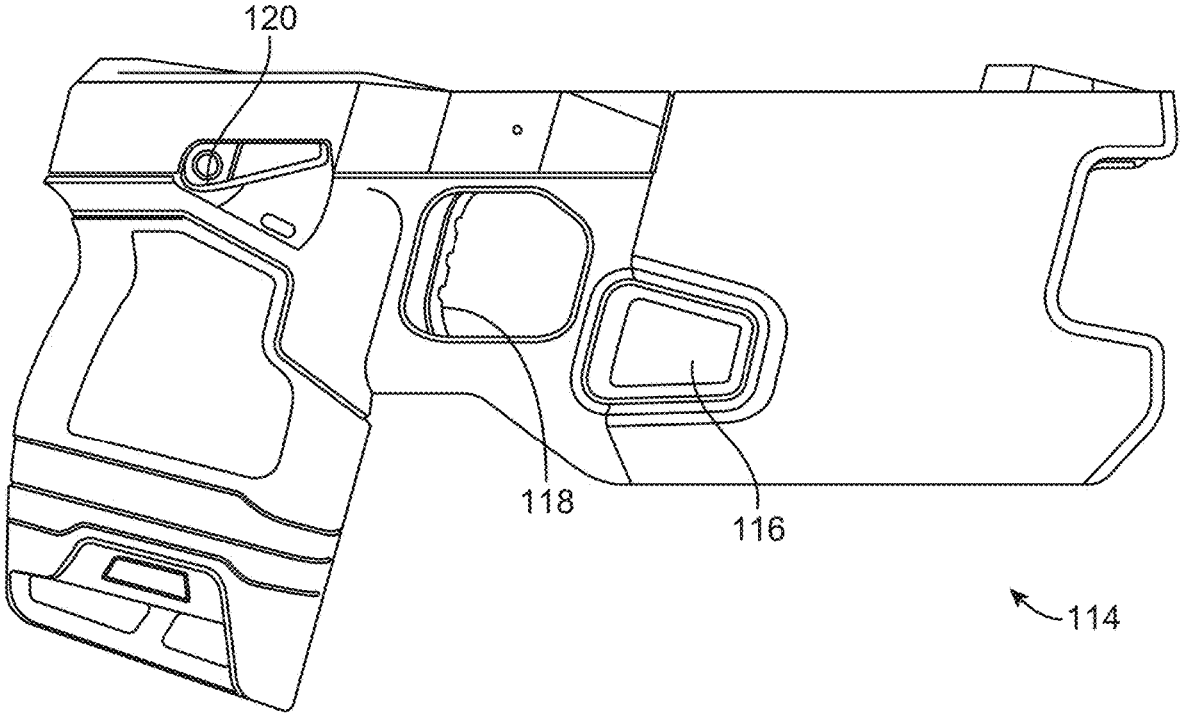
FIG. 6 exemplarily illustrates a side view of a conducted energy device (CED), according to an embodiment of the present invention.
Figure 7:
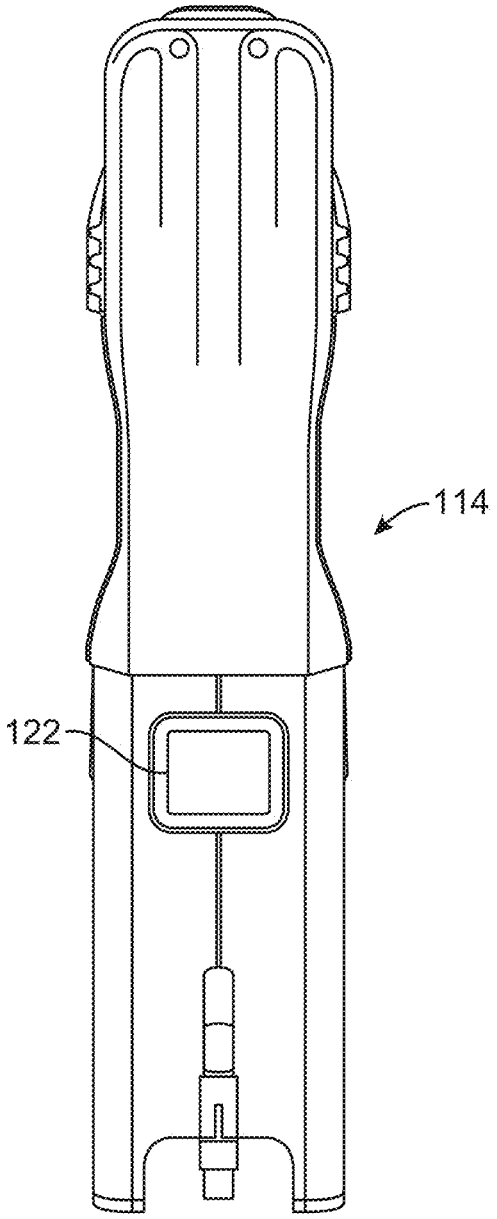
FIG. 7 exemplarily illustrates a rear view of the conducted energy device (CED), according to an embodiment of the present invention.

The switches may include, but not limited to, a trigger 118 a re-energizing switch to re-energize the conducted energy device 114, an ARC switch 116, a safety switch 120 that enables the user to shift the device 114 between the safe mode and armed mode, and a cartridge release button 122 (shown in FIG. 6 and FIG. 7). The conducted energy device 114, includes, but not limited to, stun gun, TASER® device, and so on. In one or more embodiments, the switch is used for one or more functions such as to employ a warning arc display, select cartridges, and select menu items. In another embodiment, the switch is an Arc display/Re-energize/Cartridge advance (ARC) switch.

In various embodiments, the re-energizing switch may be coupled to an outer surface of the CED housing and may be configured to move, slide, rotate, or otherwise become physically depressed or moved upon application of physical contact. For example, the re-energizing switch may be actuated by physical contact applied to the re-energizing switch. The re-energizing switch may comprise a mechanical or electromechanical switch, button, trigger, or the like. For example, the re-energizing switch may comprise a switch, a pushbutton, and/or any other suitable type of trigger. The re-energizing switch may be mechanically and/or electronically coupled to the CED electronics circuit.

Figure 2:
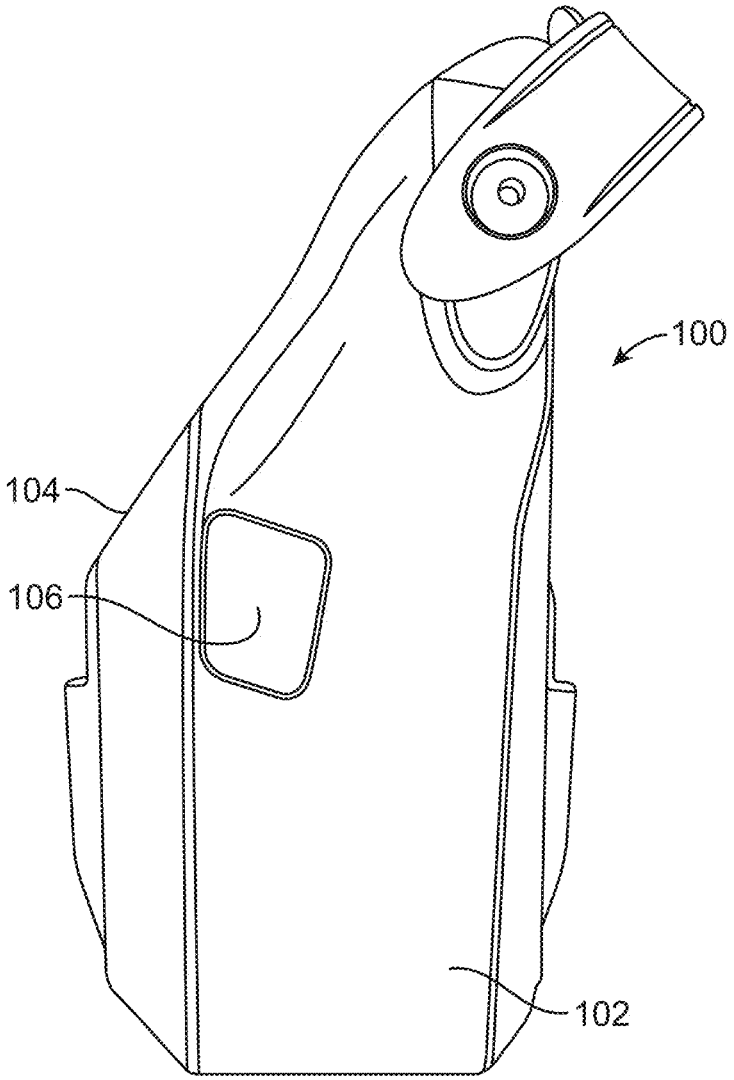
FIG. 2 exemplarily illustrates a perspective view of the holster of FIG. 1.

Referring to FIG. 1 and FIG. 2, the access module is configured at an external surface of the holster 100. The access module comprises one or more openings 106. The opening 106 is configured to expose the switch.

The opening 106 is configured at the surface corresponding to a position of the switch while the device 114 is encased within the cavity 104. The opening 106 has a shape complementary to the shape of the switch.

Figure 3:
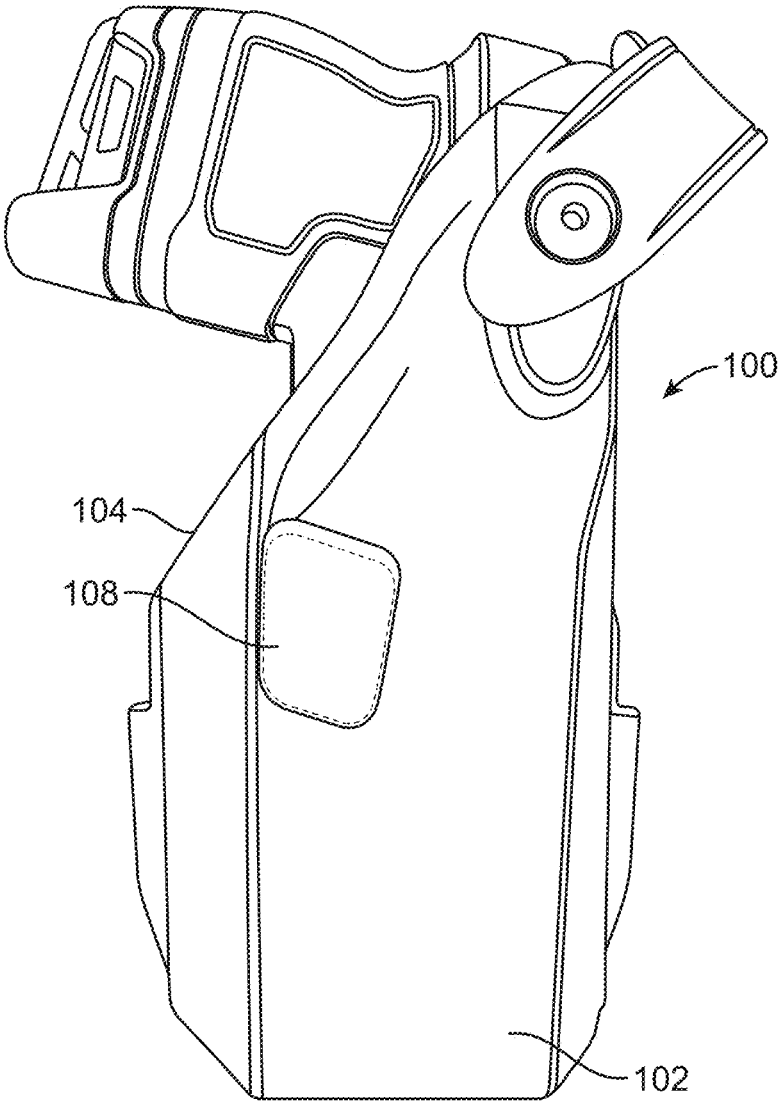
FIG. 3 exemplarily illustrates a perspective view of a holster having an opening covered by a cover member, according to another embodiment of the present invention.

Referring to FIG. 3, the access module comprises one or more openings 106 and one or more cover members 108. The openings 106 are configured to expose one or more switches at an outer surface of the conducted energy device 114. The opening 106 is configured at the surface corresponding to a position of the switch while the device 114 is encased within the cavity 104. The opening 106 has a shape complementary to the shape of the switch. The cover member 108 secured at the external surface of the holster body 102 extends across the opening 106 and encloses the opening 106.

In an embodiment, the cover member 108 comprises a first end portion and a second end portion. The first end portion is integrally and permanently connected to the external surface of the holster body 102. Further, a portion of the cover member 108 integral to the first end portion extends across the opening 106 and detachably fastened to the holster body 102 via the second end portion. The cover member 108 comprises a strap of material. The strap has a dimension larger than the dimension of the opening 106. The cover member 108 is fastened across the opening 106 by one or more fasteners. The fasteners, include, but not limited to snap-fit fastener, hook and loop fastener. In one embodiment, the first end portion of the cover member 108 is permanently connected to the external surface of the holster body 102 via a hinge. The cover member 108 could be slid away by the hinge or pin with the thumb to allow direct access to the switches.

Figure 4:
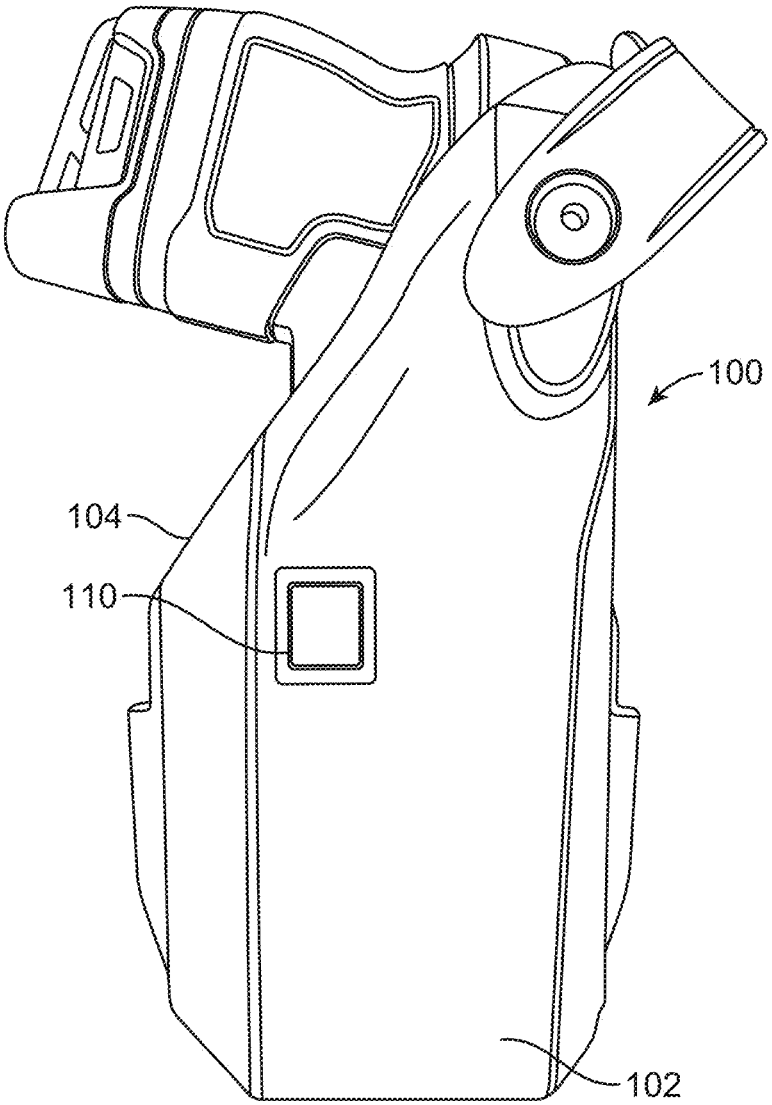
FIG. 4 exemplarily illustrates a perspective view of a holster having a depressible switch, according to yet another embodiment of the present invention.

Referring to FIG. 4, the access module comprises one or more switch members disposed at the external surface of the holster body 102. In one embodiment, the switch member is a depressible switch 110. The depressible switch 110 is disposed at the surface corresponding to a position of the switch while the device 114 is encased within the cavity 104. The depressible switch 110 is configured to move between an extended position and a depressed position. The switch is enabled to depress for a predefined depth, which enables the depressible switch 110 to contact and press against the switch of the device 114. Thereby, the depressible switch 110 activates one or more functions of the device 114. In another embodiment, the switch member could be a slidable switch that shifts between one or more positions to activate one or more switches of the device 114 to control one or more functions of the device 114.

Figure 5:
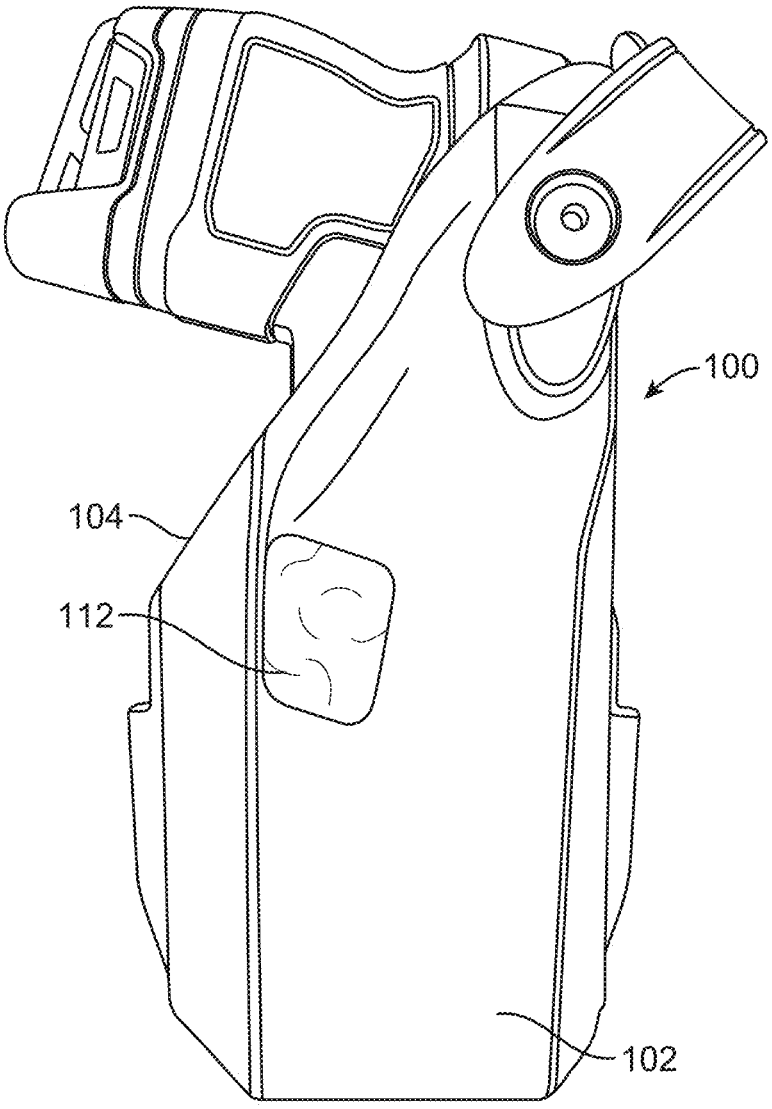
FIG. 5 exemplarily illustrates a perspective view of a holster configured with a flexible portion, according to yet another embodiment of the present invention.

Referring to FIG. 5, the access module is a flexible portion 112 integrally formed at the holster body 102. The flexible portion 112 is configured at portions that correspond to the position of the switch while the device 114 is encased within the cavity 104. The flexible portion 112 is configured to move between an extended position and a depressed position. The flexible portion 112 is enabled to depress for a predefined depth, which enables the user to contact and press the switch of the device 114. Thereby, the flexible portion 112 facilities the user to control one or more functions of the device 114 while device 114 is secured within the holster 100.

In yet another embodiment, the access module is a portion cutaway from holster body 102 (herein after referred as cutaway portion 124 (shown in FIG. 8A)). The cutaway portion 124 correspond to the position of the switch while the device 114 is encased within the cavity 104. The cutaway portion 124 is configured to expose the switch of the device 114, which provides ready access to the switch of the device 114 and eliminates the need to remove the device 114 from the holster 100 to control the switch.

In yet another embodiment, the cavity 104 of the holster body 102 is designed to enclose at least a portion of the device 114 and while exposing a portion of the device 114 comprising the switches. Further, the holster body 102 includes a strap member to secure the device 114 within the cavity 104. The exposed switches or electrical activation switches enable the user to energize or reenergize the device 114 for neuromuscular incapacitation (NMI).

In yet another embodiment, the access module comprises a wireless module. The wireless module is configured to wirelessly communicate with the conducted energy device 114 to control one or more functions of the conducted energy device 114. In one embodiment, the wireless module could be a remote switch configured to communicate with the conducted energy device 114 via short-range data communication, e.g., Bluetooth®. As used herein, the term "short-range data communication" includes any form of proximity-based device-to-device communication, unidirectional or bidirectional. This includes radio-based short-range wireless data communication such as, for instance, Bluetooth, BLE (Bluetooth Low Energy), RFID, WLAN, Wi-Fi, mesh communication or LTE Direct, without limitation. It also includes non-radio-based short-range wireless data communication such as, for instance, magnetic communication (such as NFC), audio communication, ultrasound communication, or optical communication (such as QR, barcode, IrDA). Further, the control of the device 114 while being secured in the holster 100 does not affect the user as the holster 100 is generally made of non-conductive materials.

In one embodiment, a portion of the holster body 102 that covers the re-energizing control switches are moveable. In yet another embodiment, a portion of the holster body 102 that covers the switches is removeable. This will directly expose the switches and provide easy access to them. Additionally, the holster 100 is spacious enough to accommodate the CED 114 while the wires are attached. Currently, if the barbs are deployed into a target, the wires will run from the subject to the CED 114. During holstering of the CED 114, the wires are likely to be pinched and pulled from discharged cartridges remaining in the CED 114. The spacious area of the holster 100 prevents the wires from being pinched and pulled, which would eliminate the connection of the circuit.

FIG. 6 and FIG. 7 exemplarily illustrate the different views of the conducted energy device 114, according to an embodiment of the present invention. The conducted energy device 114 is configured to be received within the cavity 104 of the holster 100. The conducted energy device 114 comprises one or more switches to control one or more functions of the conducted energy device 114. The switches include, but are not limited to, the ARC switch 116, the trigger 118, safety switch 120, and cartridge release button 122. The access modules of the holster 100 are configured to activate the switches while the device 114 is within the holster 100, in order to control one or more functions of the device 114. In an embodiment, the access modules are configured on the outer surface of the holster body 102, corresponding to the position of the ARC switch 116, the trigger 118, safety switch 120, and cartridge release button 122, in order to control the respective functions of the switches while the device 114 is secured within the holster 100.

Figure 8A:
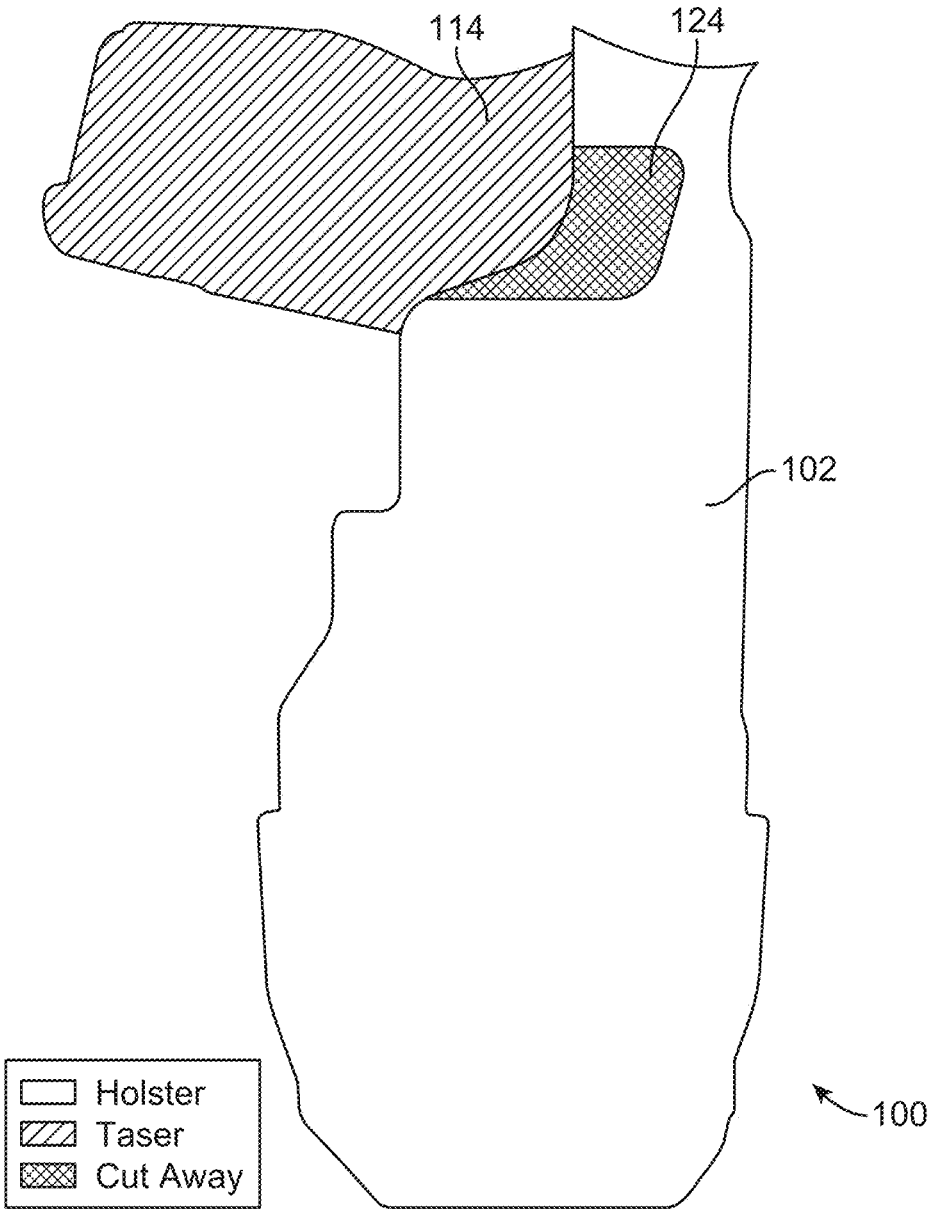
FIG. 8A exemplarily illustrates a front view of holster having a section cut-away, exposing a switch of the conducted energy device (CED), according to an embodiment of the present invention.

FIG. 8A exemplarily illustrates a front view of holster 100 having a section cut-away, exposing a selector switch 130 of the conducted energy device 114 (CED), according to an embodiment of the present invention. The conducted energy device 114 shown in FIG. 8A to FIG. 9 is a TASER® 10 device according to another embodiment of the invention. The selector switch 130 is an ambidextrous selector switch configured to serve multiple functions. The selector switch 130 is configured to move to an upward position and a downward position. The upward position of the selector switch 130 refers that the device 114 is armed. The downward position of the selector switch 130 refers that the device 114 is safe or disarmed. If the selector switch 130 is moved upwards to the upward position, the device 114 is configured to re-energize. After cartridge deployment, moving the selector switch 130 up (at the armed position) will re-energize deployed connected probes for 5 seconds. The downwards position of the selector switch 130 refers that the device 114 is in function test mode or stealth mode. The holster 100 comprises a portion, which is cutaway away from the holster body (hereinafter referred as cutaway portion 124). The cutaway portion 124 of the holster body 102 corresponds to the selector switch 130 of the device 114. The cutaway portion 124 is configured to expose the selector switch 130.

Figure 8B:
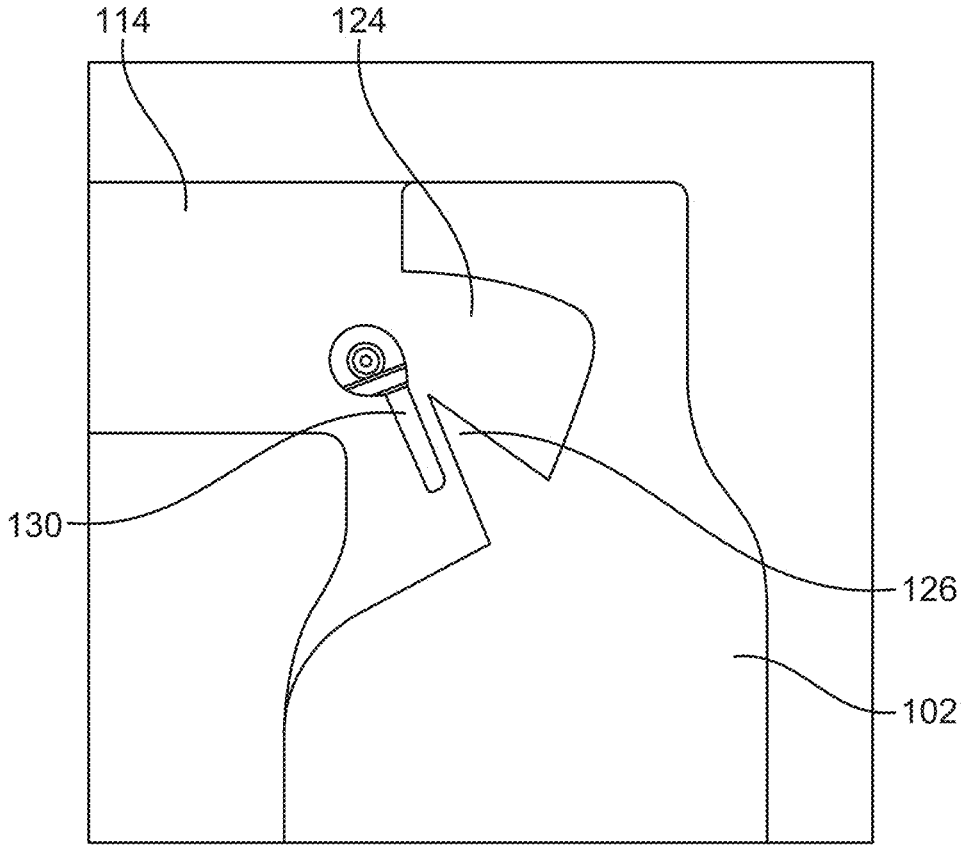
FIG. 8B exemplarily illustrates a holster having a preventor that prevents movement of the selector switch of the conducted energy device, according to an embodiment of the present invention.
Figure 9:
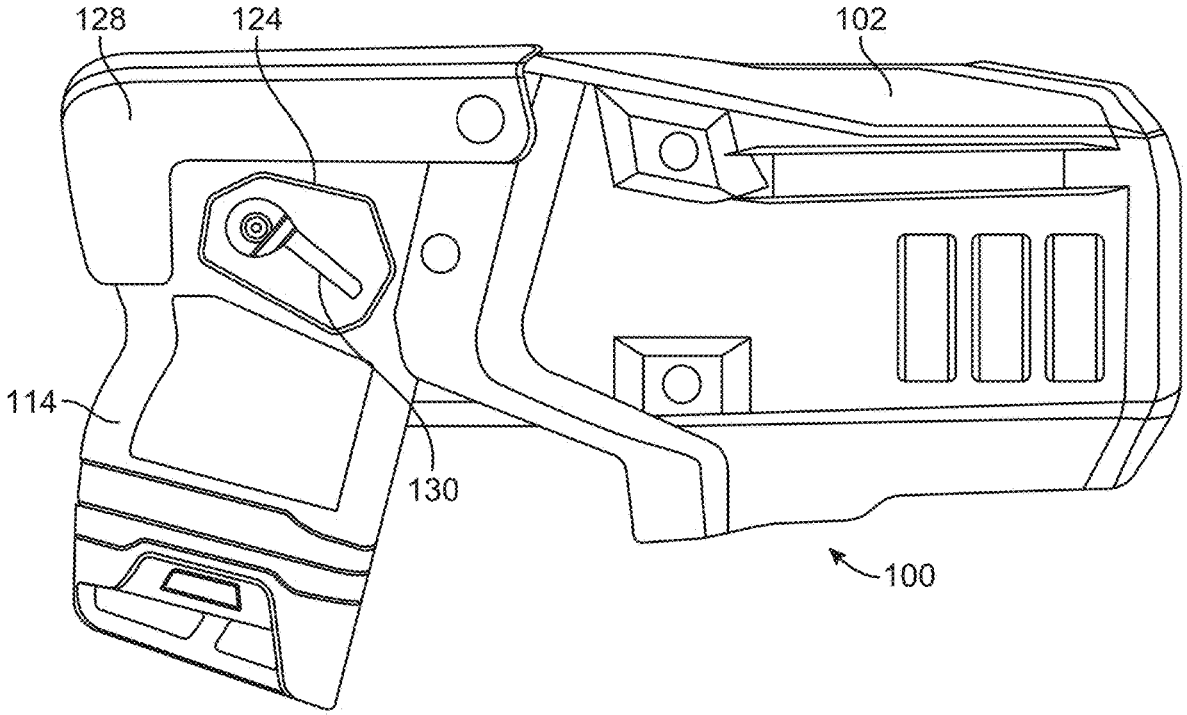
FIG. 9 exemplarily illustrates a holster housing a conducted energy device (CED), according to another embodiment of the present invention.

FIG. 8B exemplarily illustrates the holster 100 having a preventor 126 that prevents movement of the selector switch 130 of the conducted energy device, according to an embodiment of the present invention. The preventor 126 is a portion of the holster body 102 that ensures that the status of the selector switch 130 does not change unintentionally while the device 114 is secured in the holster 100. The preventor 126 extends from the holster body 102 to lie adjacent to the selector switch 130 while the conducted energy device 114 is secured within the cavity 104. FIG. 9 exemplarily illustrates the holster 100 housing a conducted energy device 114 (CED), according to another embodiment of the present invention. The holster 100 comprises a hood strap 128. The holster 100 with the hood strap 128 covers the trigger to prevent an accidental discharge of a cartridge.

Advantageously, the holster 100 of the present invention enables a user, for example, security personnel, a police officer to re-energize the conducted energy device while the device 114 is secured within the holster 100. The holster 100 enables to activate one or more functions of the device 114 without engaging both hands of the user, which is particularly advantageous while cuffing a person or while apprehending a person. Further, the holster 100 enables the user to energize or reenergize the device 114 for neuromuscular incapacitation (NMI) without alerting an offender being apprehended.

It should be understood that the holsters and devices illustrated in FIGS. 1-9 are only some examples and that many other possible configurations and component configurations are contemplated. For example, different types of devices (e.g., any suitable conducted energy device) and assemblies may be used in addition to or instead of the those described herein. In one embodiment, the holster is configured as an attachment member, for example, to one or more of a vest, belt, strap, or harness to secure the holster to the body of a user.

Although the features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A holster for a conducted energy device, comprising:

a holster body having a cavity to receive the conducted energy device, wherein the conducted energy device comprises one or more switches to control one or more functions of the conducted energy device, and an access module integrated at an outer surface of the holster body at a location corresponding to a user-actuatable switch, the access module comprising a depressible portion integrally formed with the holster body and configured to be depressed by a user for a predefined depth while the conducted energy device remains secured within the cavity, depression of the depressible portion contacting and pressing against the user-actuatable switch to activate the switch and thereby control the one or more functions including energization of the conducted energy device.

2. The holster of claim 1, wherein the depressible portion overlies the user-actuatable switch.

3. The holster of claim 1, wherein the access module further comprises an opening through the holster body positioned to expose the user-actuatable switch, and a cover member extendable across the opening to manage access to the opening.

4. The holster of claim 3, wherein the cover member is biased and configured such that opening the cover requires a user action oriented away from a direction of draw from the holster, for example by a catch, latch, or detent.

5. The holster of claim 3, wherein the cover member is coupled to the holster body via a hinge and is configured to pivot about the hinge to provide access to the opening.

6. The holster of claim 1, further comprising a preventor configured to lie adjacent to an ambidextrous selector switch of the conducted energy device while the device is secured within the cavity, thereby inhibiting movement of the selector switch.

7. The holster of claim 1, wherein the holster is configured with additional space within cavity to accept wire tethers that connect to deployed electrodes while the conducted energy device is secured within the holster.

8. The holster of claim 1, wherein the depressible portion is enabled to depress for a predefined depth to allow the user to press the depressible portion against the user-actuatable switch of the conducted energy device to control the functions of the conducted energy device.

9. A holster for a conducted energy device, comprising:

a. a holster body having a cavity to receive the conducted energy device; and b. an access module comprising: (i) an opening through an outer surface of the holster body positioned to expose a user-actuatable switch of the conducted energy device while the device is secured within the cavity; and (ii) a cover member coupled to the holster body and extendable across the opening to manage access to the opening, the cover member configured such that opening the cover requires a two-step manipulation oriented away from a direction of draw from the holster.

10. The holster of claim 9, wherein the cover member is coupled via a hinge and is configured to pivot about the hinge to provide access to the opening.

11. The holster of claim 9, further comprising a preventor, wherein the cover member mechanically interlocks with the preventor such that energization is inhibited unless the cover is in an open position.

* * * * *